United States Patent [19]

Struck

[11] 4,437,714

[45] Mar. 20, 1984

[54] PORTABLE BAR-CABINET

[76] Inventor: Gordon K. Struck, 11848 26th Ave. South, Seattle, Wash. 98168

[21] Appl. No.: 332,921

[22] Filed: Dec. 21, 1981

[51] Int. Cl.[3] ..... A47B 57/00; A47B 81/00

[52] U.S. Cl. ..... 312/281; 312/290; 312/306; 312/272; 108/25

[58] Field of Search ..... 312/281, 272, 290, 306, 312/DIG. 33; 108/25

[56] References Cited

U.S. PATENT DOCUMENTS

| | | | |
|---|---|---|---|
| 750,673 | 1/1904 | Mason | 312/290 |
| 1,338,833 | 5/1920 | Kornsweet | 312/281 |
| 1,590,586 | 6/1926 | McDonald . | |
| 1,787,347 | 12/1930 | Wellemeyer | 312/281 |
| 1,994,857 | 3/1935 | Krause | 312/186 |
| 2,229,320 | 1/1941 | Balzano et al. | 312/281 |
| 2,351,610 | 6/1944 | Hamberg | 190/12 |
| 2,556,153 | 6/1951 | Collins | 312/281 |
| 2,557,218 | 6/1951 | Ewell | 312/276 |
| 2,604,373 | 7/1952 | Beriou et al. | 312/300 |
| 2,725,274 | 11/1955 | Stivale | 312/290 |
| 2,764,462 | 9/1956 | McDonald | 312/140.2 |
| 2,812,227 | 11/1957 | Hill | 312/306 |
| 2,837,388 | 6/1958 | Majeroni et al. | 108/25 |
| 3,097,028 | 7/1963 | Pieschel | 312/277 |
| 3,261,651 | 7/1966 | Prowse | 312/290 |
| 3,347,346 | 10/1967 | Young | 190/42 |
| 4,161,234 | 7/1979 | Munn | 312/306 |
| 4,163,592 | 8/1979 | Nelson | 312/281 |
| 4,184,433 | 1/1980 | Green | 312/272 |

*Primary Examiner*—Victor N. Sakran
*Attorney, Agent, or Firm*—Delbert J. Barnard

[57] ABSTRACT

An ice tub (34) fits through a large opening in the top (20) of a cabinet, down into an interior space within the cabinet, and is supported at its bottom on the floor of such space. At its top, the ice tub (34) is flush with the top of the cabinet. A pair of panels (26, 28) are hinge connected (at 70) to the cabinet for movement between outwardly projecting counter-forming positions (FIG. 2) and closed positions (FIG. 1) in which they overlay the top (20) of the cabinet. A plurality of minor openings (22, 24) are formed in the top of the cabinet along one side and both ends of the tub. The side located openings (22) receive small containers (46) for condiments. The end located openings (24) receive containers (42) for alcohol beverage bottles (44). Containers (42) rest on top portions (38) of a pair of box beams (36) which extends laterally of the cabinet, at the ends of the cabinet, to provide structural stiffness for the side (12, 14) and endwalls (16, 18) of the cabinet, to compensate for the loss in structural strength in the top (20) caused by formation of the openings. The condiment and alcohol beverage bottle holding containers (46, 42), a mixer container (54) which is detachably mountable onto the sidewall of the cabinet facing the bartender (FIG. 2), and a cash drawer, are located inside of the ice tub and within an inner space of the cabinet bordering the ice tub, when the cabinet is folded for storage.

17 Claims, 5 Drawing Figures

PORTABLE BAR-CABINET

DESCRIPTION

1. Technical Field

This invention relates to the provision of a portable bar in the form of a relatively small cabinet which can be carried in a folded condition like a suitcase, and then be opened up on a conventional dining doom table or the like to serve as a bar.

2. Background Art

Hotels and convention centers have a need for a portable fold-up bar which is small enough so that it can easily be carried from one place to another and does not occupy much space when it is being stored between uses. The principal object of this invention is to provide a portable bar which meets this criteria.

Hotels and convention centers generally have a plurality of meeting rooms which are arranged in different ways, depending upon the needs of a particular user. Some users request the presence of a bar and some do not. The particular use to which the room is being put, e.g. dancing, a meeting place in which chairs are needed, etc., or the preference of the user, often determine where the bar must be placed, when a bar is requested.

It is common practice for hotels to have portable bar structures which are in the nature of a cabinet which sets on the floor and includes an upper portion adapted to both provide counter space and space for alcoholic beverage bottles, mixer bottles and such condiments as olives, cocktail onions, lemon twists, lime twists, etc. These bar structures are referred to as being "portable" because they are moved from place to place. However, they are relatively large structures and require the use of "dollys" or the like in order to move them, and they occupy a considerable amount of storage space. Storage space in hotels and convention centers is usually quite scarce.

Examples of various types of portable bar structures of a cabinet type, or similar cabinet structures, are shown by these U.S. Pats.: No. 1,590,586, granted June 29, 1926, to Edward J. McDonald; No. 1,994,857, granted Mar. 19, 1935, to Ernst Krause; No. 2,351,610, granted June 20, 1944, to William A. Hamberg; No. 2,604,373, granted July 22, 1952, to William P. Beriou and Eugene G. Wilson; No. 2,725,274, granted Nov. 29, 1955, to Santo Stivale; No. 2,764,462, granted Sept. 25, 1956, to Frank S. McDonald; and No. 3,097,028, granted July 9, 1963, to Walter L. Pieschel.

The portable structure disclosed by U.S. Pat. No. 2,725,274 is, in my opinion, the most pertinent patent of this group. However, the approach taken by the patentee is different than my approach and the cabinet structure disclosed by the patent still has the problem of being large enough to be difficult to move and because of its size, requires a considerable amount of storage space.

U.S. Pat. No. 2,557,218, granted June 19, 1951, to Robert G. Ewell and U.S. Pat. No. 3,347,346, granted Oct. 17, 1967 to Jesse R. Young, disclose portable personal bars which are of about the same size as an attache case or small suitcase. Portable bars of this type would be unacceptable for use in a hotel or convention center setting.

The above described patents, together with the prior art patents that were cited by the patentees and/or the Patent Office before granting them, as listed in such patents, should be carefully considered for the purpose of properly evaluating the subject invention and putting it into proper perspective relative to the prior art.

DISCLOSURE OF THE INVENTION

The present invention relates to the provision of a fold-up type portable bar which when folded is the size of a relatively large suitcase or trunk, but still small enough to be carried by a handle much in the manner that a suitcase is carried. In use, the portable bar-cabinet is set onto the top of a conventional dining room table or the like, and is opened up to create a bar structure having a relatively large amount of counter space, and at least adequate storage space and room for the alcoholic beverages, the mixers, ice, etc., which the bartender needs in which to perform his function.

In basic form, the portable bar-cabinet of the present invention comprises a top, a bottom, two sidewalls and two endwalls which together define a cabinet having an innerspace. The top includes a major opening for receiving a removable ice tub. The ice tub nat includes laterally outwardly projecting peripheral flange. The cabinet top may include a recess bordering the tub opening, sized to receive the tub flange, for mounting the top of the tub substantially flush with the top of the cabinet. The top of the cabinet also includes a plurality of minor openings offset from the tub opening on at least one side of the tub. In the preferred embodiment, these minor openings are provided on three sides of the tub opening. The minor openings are adapted for receiving removable holders for the alcoholic beverage bottles and the condiments. The cabinet innerspace includes a tub body receiving space immediately below the major opening and a storage space situated on one or more sides of the tub space. A pair of counter panels are hinge connected to the top of the cabinet. The hinges serve to mount the counter panels for swinging movement between a folded position in which the panels overlay the top of the cabinet and a counter forming position in which the counter panels project laterally outwardly from opposite sides of the cabinet, in wing-like fashion. Support means are provided for supporting the counter panels in their counter forming positions. The cabinet further includes handle means on one of its sides by which the user can pick up the bar-cabinet when it is in its folded condition and carry it from one place to another.

Another important aspect of the invention is to provide the bar-cabinet with integral box beams which perform two separate functions. Firstly, they provide a support surface for the bottoms of the removable containers which receive the bottles of alcoholic beverages. Collectively, these bottles and the removable containers in which they are contained, comprise a considerable amount of weight. It would be undesirable to "hang" this weight on the top because the top has been weakened considerably by the formation in it of the major and minor openings. The second function of the integral box beams is to stiffen the lower corner portions of the cabinet at opposite ends of the cabinet. This stiffening effect makes the four sides of the cabinet relatively rigid in position relative to each other and the bottom, aside from the top. Thus, the sidewalls and bottom can be constructed of relatively thin panel materials, e.g. ¾ inch plywood, and be rigid in form without having to depend on the top for much structural reinforcement.

The space inside of the ice tub and the space within the bar-cabinet which borders the ice tub can be used for receiving the removable containers and such other items as a cash drawer and in some cases the brace means for the counter panels.

In the preferred form, the brace means is in the form of a plurality of detachable legs. These legs include threaded studs at their upper ends which are screw connected to mounting plates which are carried by the counter panels. The legs are of such a length that they will support the counter panels in a substantially horizontal positions when the lower ends of the legs are resting on the top of the table on which the bar-cabinet is situated.

The bottles of mixer may be held within a container that is adapted to be detachably secured to the outside of the bar-cabinet, on the sidewall which is closest to the bartender during use. A cash drawer assembly may be removably mounted onto one of the counter panels. For example, complementary fasteners may be provided on the cash drawer assembly and on one of the counter panels, so that when the counter panels are in their in use position, the cash box may be secured to a lower portion of a counter panel, in easy reach of the bartender.

In preferred form, the ice tub is equipped with a drain opening near its bottom. A drain hose is provided which is insertable first through an opening in a sidewall of the cabinet and then onto a drain opening fitting or receptacle on the tub. The lower end of the drain hose may merely depend down into a bucket set below the table.

In a second embodiment, the removable support legs are replaced by wing braces, each of which are movable between a folded position against an endwall of the cabinet and an in use position in which it extends substantially perpendicularly out from the end wall of the cabinet, below its counter panel.

These and other objects, advantages and features of the invention will be apparent from the following description of a preferred embodiment of the invention.

BRIEF DESCRIPTION OF THE DRAWINGS

In the drawings, like element designations refer to like parts throughout, and.

BEST MODE FOR CARRYING OUT THE INVENTION

Figures 1, 2:
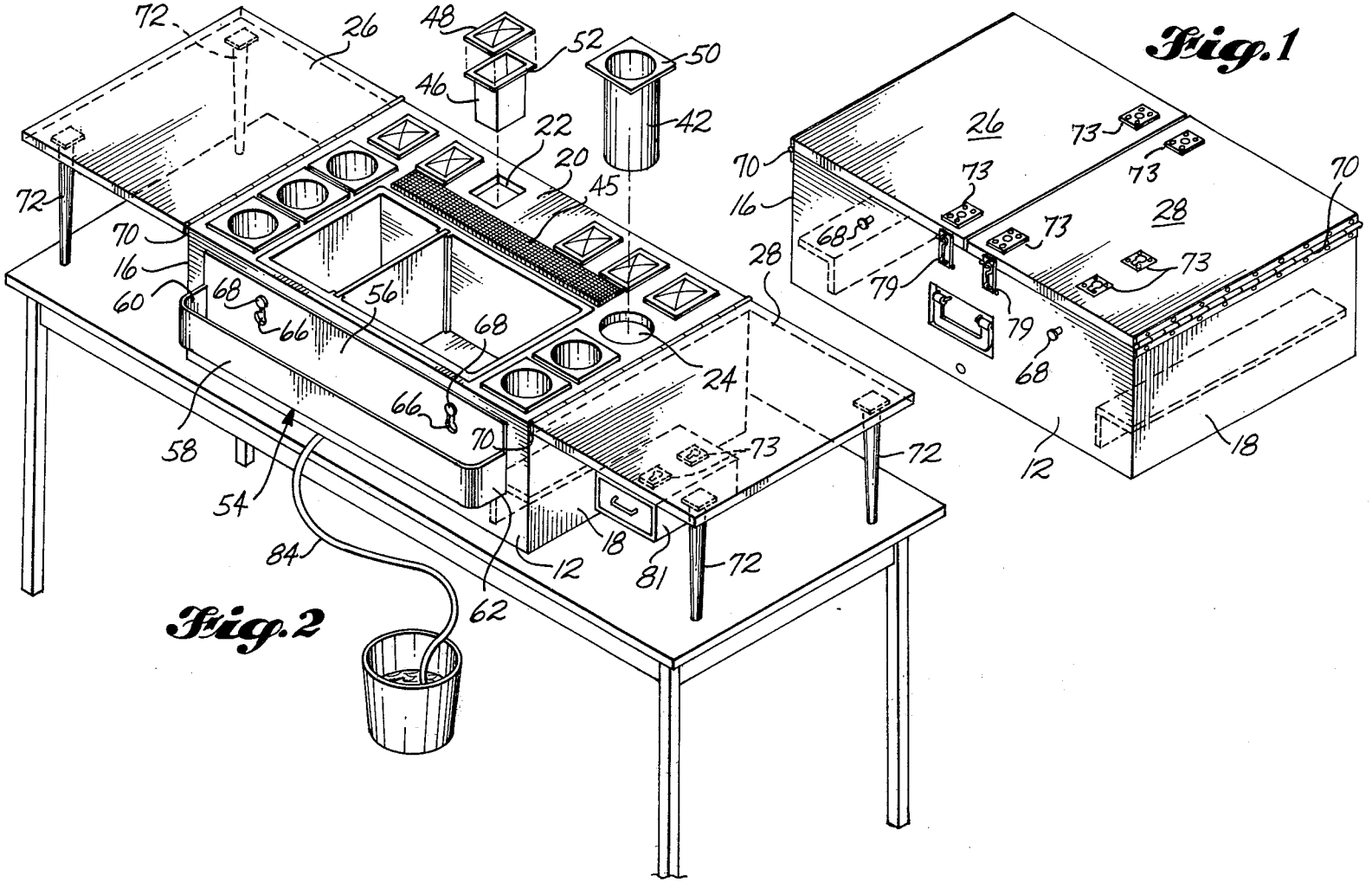
FIG. 1 is a pictorial view taken from above and looking towars the bartender's side and one end of a portable bar-cabinet constructed in accordance with the present invention, shown in its folded position.
FIG. 2 is a pictorial view taken from the same aspect as FIG. 1, but showing the portable bar-cabinet opened into its use position, and showing it being supported on the top of a conventional dining room table.
Figure 3:
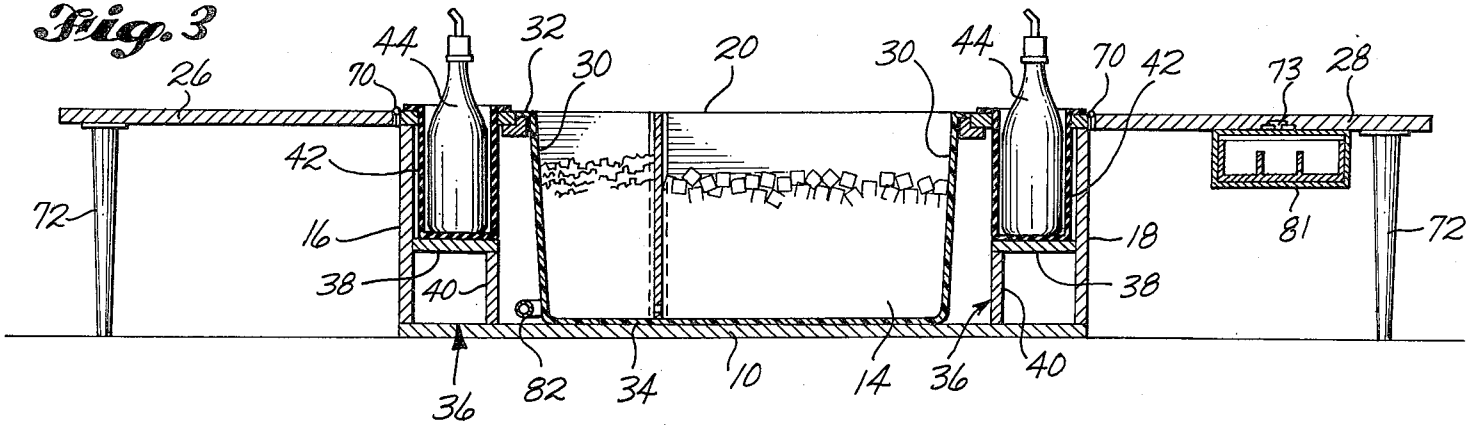
FIG. 3 is a longitudinal sectional view taken through the portable bar-cabinet, showing the dual function of box beams which extend laterally of the cabinet at each of its ends.

Referring to FIGS. 1–3, the portable bar-cabinet that is shown by these figures comprises a solid bottom 10, a pair of solid sidewalls 12, 14, a pair of solid endwalls 16, 18 and a top 20.

Top 20 is provided with a major ice tub receiving opening surrounded on three sides by a plurality of minor openings, some of which are designated 22 and 24. The portable bar-cabinet also includes a pair of counter panels 26, 28. The bottom 10, sidewalls 12, 14, endwalls 16, 18, top 20 and counter panels 26, 28 all may, for example, be constructed from three quarter inch plywood. These members may be finished with a suitable finish of a type applied by a brush, or, preferably, they may be covered by a suitable plastic lamina or the like.

As should be apparent, the making of the major and minor openings in the top 20 removes a substantial amount of material, reducing the ability of the top 20 to perform as a structural frame member. Some of the stiffness and strength that is removed by forming the major opening is put back in again by framing the major opening with a piece of molding 30 which extends completely about the periphery of the major opening. This frame 30 performs two functions. Firstly, it strengthens the top panel 20. Secondly, it provides a support ledge for an outwardly projecting flange which extends about the upper periphery of an ice tub 34 which fits down into the major opening. As shown by FIG. 3, the frame members 30 each have a L-shaped cross section. The horizontal side of the L underlines a portion of the plywood panel 20 which immediately borders the major opening. The dimensions of the member 30 are such that the upper edge of the vertical side of the L is spaced downwardly from the top surface of the top panel 20, a distance that is substantially equal to the thickness of the tub flange 32. As a result, when the tub 34 is in place, its upper surface is substantially flush with the upper surface of top 20.

In accordance with one aspect of the invention, the weakening of the top 20 is further compensated for by constructing the cabinet to include a box beam 36 at each of its ends. The box beams 35 extend laterally across the portable bar-cabinet. As shown in FIGS. 1 and 3, the box beams 36 may be simply constructed by securing together a horizontal panel 38 and a verticl panel 40, of one-half inch plywood, and connecting them together and to the endwalls and the bottom of the cabinet. The presence of box beams 36 make the lower corner portions of the cabinet at each end of the cabinet very stiff. This stiffening is transmitted upwardly to endwalls 16, 18, to a considerable extent, and also upwardly to the sidewalls 12, 14, to a lesser extent. However, the endwalls and the sidewalls mutually brace each other, so in this manner the stiffening effect provided by the box beams 36 is adequately distributed between the sidewalls 12, 14 and the endwalls 16, 18.

The box beams 36 perform a second function. They provide a bottom support for removable containers 42 which are inserted down into the rows of minor openings which are formed in the top 20 at the opposite ends of the ice tub receiving major opening. These containers 42 are provided to receive the bottles of alcoholic beverage. These bottles 44 and the containers 42, together represent a considerable amount of weight. By carrying this weight on the box beams 36, such weight is removed from the weakened top 20.

In the illustrated embodiment, the row of minor openings 22 which are provided along the side of top 20 that is opposite the ice tub 34 receive small holders 46, equipped with lids 48. These holders 46 receive such things as maraschino cherries, olives, cocktail onions, lemon twists, lime twists, and orange twists.

The containers 42, 46 are provided with top flanges 50, 52, respectively, adapted to rest down on the portion of top 20 immediately surrounding the openings 22, 24. These containers 42, 46 are meant to be removed from the openings 22 and 24 and placed inside of the cabinet when it is desired to store the portable bar-cabinet.

Figure 5:
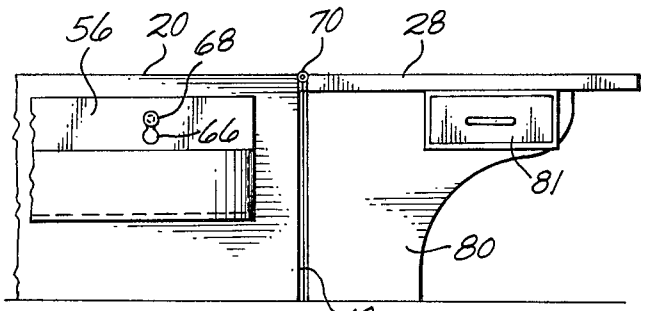
FIG. 5 is a fragmentary elevational view of an end portion of the portable bar-cabinet, showing the support for the counter panel moved out into its use position.

In preferred form, a holder 54 for bottles of mixer is adapted to be hung onto the outside of sidewall 12. Holder 54 is shown to comprise a backwall 56, a frontwall 58, endwalls 60, 62 and a bottom 64 (FIG. 5). Backwall 56 projects upwardly above frontwall 58 and is formed to include a pair of keyhole openings 66, each having its slot portion directed upwardly. A pair of headed hang pins 68 are provided on the outside of sidewall 12. The head portions of hang pins 68 are sized to pass through the enlarged portions of the keyhole openings 66 but not through the slots. The shank portions of the hang pins 68 are sized to be received in the slots. The mixer holder 54 is shown in its use position in both FIGS. 2 and 5. It is another item which is stored inside of the cabinet when not in use.

As clearly shown by FIGS. 1–3, the counter panels 26, 28 are each hinge connected along one edge to the upper edge of one of the endwalls 16, 18, such as by a piano hinge 70. Preferably, the counter panels 26, 28 are equal in size and together they equal in area the top 20. As shown by FIG. 2, the hinge mounts 70 mounts the panels 26, 28 for movement between a folded position in which they directly overlay the top 20, and their free edges are substantially together, and an unfolded or in use position in which they project laterally outwardly from the ends of the cabinet and in effect form continuations of the top 20.

In preferred form, the counter panels 26, 28 are supported while in their in use positions by a plurality of detachable support legs 72. These support legs 72 include threaded bolt ends of their upper ends which screw into threaded sockets provided within mounting fittings 73 which are attached to the counter panels 26, 28.

Figure 4:
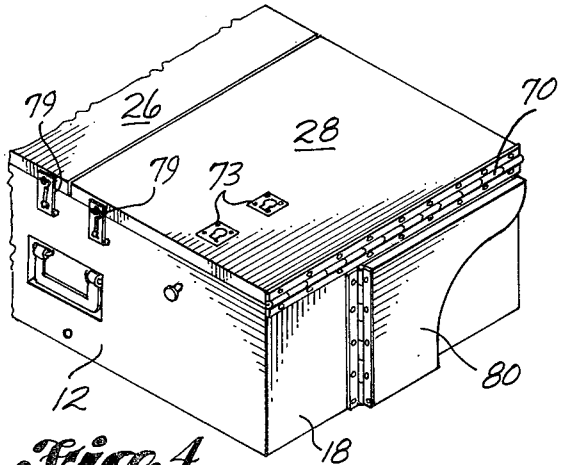
FIG. 4 is fragmentary pictorial view of the portable bar-cabinet in its folded condition, showing a modified form of support for the counter panels.

Alternately, the support legs 72 may be replaced by folding wings 80 which are movable between a folded position (FIG. 4) in which they lay next to the endwalls 16, 18, and an in use position (FIG. 5) in which they project substantially perpendicularly outwardly from the endwalls 16, 18, with their upper edges directly unlaying the counter panels 26, 28. Any suitable means may be provided for holding the support wings 80 in against the endwalls 16, 18 when they are not in use. Similarly, any suitable means may be provided for locking the counter panels 26, 28 into their folded positions, such as hook locked hasps 79.

A bartender generally needs a cash drawer 81. In accordance with an aspect of the invention, the frame for the cash drawer 81 is provided with headed mounting studs and the side of one of the counter panels (e.g. panel 28) which is directed downwardly during use is provided with keyhole providing fittings for receivig the headed mounting studs. In this manner, the cash box 81 can be easily mounted and demounted from the counter panel 28. As shown by FIGS. 2 and 3, the cash box 81 may be mounted to present the handle of its drawer generally at the plane of the outer surface of sidewall 12.

Preferably, the ice tub 34 is provided with a drain hose. Preferably, the ice tub 34 includes a receptacle 82 which may be provided on an endwall. An opening is provided in sidewall 12 of the bar-cabinet for passage of a drain hose 84. The upper end of the drain hose 84 is adapted to slip onto and engage the receptacle 82. The opposite end of the hose is merely placed into a bucket that is positioned below the unit.

The hose, the mixer holders 54, the several holders 42, 46, the support legs 72 (if used), and the cash drawer 81 are all placed inside of the portable bar-cabinet when it is desired to ready such unit for storage. Some of these items may be placed inside of the ice tube 32 and the others are placed in the inner space region of the cabinet which is alonside that portion of the inner space which accomodates the ice tub.

The sidewall 12 is provided with a handle similar to a suitcase handle. This handle is used for carrying the folded bar-cabinet from place to place.

As can readily be seen, the bar-cabinet occupies a relatively small amount of space when folded (FIG. 1). Also, its surfaces which are presented toward the customer during use of the bar are protected and will not become scared in the event other items are stacked on top of the bar-cabinet in the storage room.

When the bar-cabinet is needed, such as for example, to provide a bar setup in a meeting room, the bar-cabinet is picked up and carried like a suitcase to the room in which it is to be used. Then, it is set onto a conventional dining room table or the like. Then, the counter panels 26, 28 are unlocked and swung into the position shown by FIG. 2. This procedure includes installing the support legs 72, moving the support braces into place, depending on which system is being used. The contents of the ice tub are removed and the tub itself is removed for the purpose of getting to the elements which are stored within the bar-cabinet in the inner space bordering the ice tub. All of these elements, each of which have been previously described, are then set into place. A bucket is found and the lower end of the drain hose is set into the bucket. Then, bottles of mixer are set into the mixer holder 54, iced is placed into the ice tub 34, the maraschino cherries, olives, cocktail onions, etc. are placed within the containers 46 and such containers are placed within the openings 22, the bottle containers 42 are set into the openings 24, and the bottles of alcoholic beverage 44 are set down into these containers 42. Also, the cash drawer 81 is set into place. The upper end of the drain hose is plugged onto the plug receptacle 82 and the lower end of the drain hose is placed within the bucket.

The bar-cabinet may be provided with a mat 45 on which the drink glasses are set while the drinks are being made. This mat 45 is of conventional construction and comprises a continuous sheet bottom and a plurality of short fingers projected upwardly from such bottom. The mat 45 is received within a recess formed in top 20 between the tub opening and the row of openings 22. This mat 45 may be stowable inside of the bar-cabinet, or it may be recessed deep enough within the top 20, so that like ice tub 32, it can be left in place when the counter panels 26, 28 are swung into their folded positions.

It should be evident that when the counter panels 26, 28 are swung outwardly into their in use position, the upper surface of the portable bar is quite large. The storage space provided by the main body of the cabinet is large enough to accomodate six bottles of alcoholic beverage, six types of condiments, and a considerable quantity of ice. The counter that is provided will accomodate a large number of customers on the customer side of the table. If desired, a fabric drape may be hung around the three sides of the table which are directed towards the customer. The drape material may be long enough to extend completely down to the floor.

It is to understood that the above presented It is to understood that the above presented description relating to the illustrated embodiments is provided for example purposes only and that the scope of the invention is to be established by appropriate legal interpretations of the appended claims.

I claim:

1. A portable bar-cabinet comprising:

a top, bottom, two sidewalls and two endwalls, together defining a cabinet having an inner space;

said top including a major opening for receiving a removable ice tub having an upper boundary which is substantially flush with the upper surface of the top when the tub is in said major opening;

said top also including a plurality of minor openings offset outwardly from the tub opening for receiving removable holders;

said cabinets inner space including a tub receiving space below the major opening and a storage space outwardly adjacent the tub receiving space;

a pair of counter panels;

hinge means connecting the counter panels to the cabinet substantially where the endwalls intersect the top, for swinging movement between a folded position in which the counter panels extend over the cabinet top and a counter forming, in use position in which the counter panels project laterally outwardly like wings from opposite sides of the cabinet top;

support means for supporting said counter panels in their counter forming positions;

handle means carried by one of the sidwalls of the cabinet, enabling the cabinet to be picked up and carried like a suitcase when the counter panels are in their folded positions; and means forming a pair of stiffener beams which extend laterally across the bar-cabinet where the endwalls of the cabinet intersect the bottom of the cabinet, said stiffener beams providing stiffness to both the endwalls and the sidewalls, and also presenting an upper support surface on which at least some of the removable containers rest, so that the weight of such containers and their contents are not carried by the top.

2. A portable bar-cabinet according to claim 1, for use with a ice tub of a type having a laterally outwardly projecting peripheral flange, wherein said top includes a tub flange receiving recess bordering said opening and of a depth that is substantially equal to the thickness of the tub flange.

3. A portable bar-cabinet according to claim 1, wherein the support means for said counter panels comprise a plurality of detachable legs, and means at the upper ends of the legs and on the counter panels for removably securing the legs to the sides of the counter panels which are directed downwardly when the counter panels are in their counter forming in use positions.

4. A portable bar-cabinet according to claim 1, wherein the bottom, the sidewalls, the endwalls, are formed from panels of plywood, and the stiffener beams are formed from panels of plywood which are joined together and to the endwalls, the sidewalls, and the bottom to form hollow box beam structures.

5. A portable bar-cabinet according to claim 1, wherein the support means for the counter forming panels comprises a wing member at each end of the bar-cabinet, adapted to be swung between a folded position, in against the endwall of the cabinet and a support position in which it projects outwardly from such endwall and underlies a substantial portion of the counter panel.

6. A portable bar-cabinet according to claim 2, wherein said tub flange receiving recess is formed by molding strips which at least partially frame the major opening, and which are connected to the portion of the top which immediately borders the opening, and functions to stiffen the top about said opening.

7. A portable bar-cabinet according to claim 1, further comprising a removable container for bottles of mixer and means for removably securing such containers to the sidewall of the bar-cabinet which is directed toward the bartender during use of the bar-cabinet.

8. A portable bar-cabinet according to claim 1, further comprising a cash drawer assembly and means for detachably securing such cash drawer assembly to one of the counter forming panels.

9. A portable bar comprising:

a top, bottom, two sidewalls and two endwalls, together defining a cabinet having an inner space;

a removable ice tub having sidewalls, a bottom and an upper boundry;

said top including a major opening for receiving said ice tub, with the upper boundary of the tub being substantially flush with the upper surface of the top when the tub is in said major opening;

said top also including a plurality of minor openings offset outwardly from the tub opening;

a holder removably insertable in each of said minor openings;

said cabinets inner space including a tub space below the major opening and a storage space adjacent the tub space;

a pair of counter panels;

hinge means connecting the counter panels to the cabinet substantially where the endwalls intersect the top, for swinging movement between a folded position in which the counter panels extend over the cabinet top and a counter forming, in use position in which the counter panels project laterally outwardly like wings from opposite sides of the cabinet top;

support means for supporting said counter panels in their counter forming positions;

handle means carried by one of the sidewalls of the cabinet, enabling the cabinet to be picked up and carried like a suitcase when the counter panels are in their folded positions;

said holders being storable within said tub and/or the storage space adjacent the tub space; and a removable container for bottles of mixer and means for removably securing such container to the sidewall of the cabinet which is directed toward the bartender during use, said storage space being adapted to receive and store said container.

10. A portable bar according to claim 9, for use with a ice tub of a type having a laterally outwardly projecting peripheral flange, wherein said top includes a tub flange receiving recess bordering said opening and of a depth that is substantially equal to the thickness of the tub flange.

11. A portable bar according to claim 9, further comprising means forming a pair of stiffener beams which extend laterally across the cabinet where the endwalls of the cabinet intersect the bottom of the cabinet, said stiffener beams providing stiffness to both the endwalls and the sidewalls, and also presenting an upper support surface on which at least some of the removable containers rest, so that the weight of such containers and their contents are not carried by the top.

12. A portable bar according to claim 11, wherein some of the minor openings are positioned above the stiffener beams, and the holders include beverage bottle holders insertable into such minor openings which include bottoms and which are adapted to fit down into said openings with their bottoms resting on said stiffener beams.

13. A portable bar according to claim 9, wherein the support means for said counter panels comprise a plurality of detachable legs, and means at the upper ends of the legs and on the counter panels for removably securing the legs to the sides of the counter panels which are directed downwardly when the counter panels are in their counter forming in use positions.

14. A portable bar according to claim 11, wherein the bottom, the sidewalls, the endwalls, are formed from panels of plywood, and the stiffener beams are formed from panels of plywood, which are joined together and to the endwalls, the sidewalls, and the bottom to form hollow box beam structures.

15. A portable bar according to claim 9, wherein the support means for the counter forming panels comprises a wing member at each end of the bar-cabinet, adapted to be swung between a folded position, in against the endwall of the cabinet and a support position in which it projects outwardly from such endwall and underlies a substantial portion of the counter panel.

16. A portable bar according to claim 10, wherein said tub flange receiving recess is formed by molding strips which at least partially frame the major opening, and which are connected to the portion of the top which immediately borders the opening, and functions to stiffen the top about said opening.

17. A portable bar according to claim 9, further comprising a cash drawer assembly and means for detachably securing such cash drawer assembly to one of the counter forming panels.

* * * * *